US009791174B2

(12) United States Patent
Izadi-Zamanabadi et al.

(10) Patent No.: US 9,791,174 B2
(45) Date of Patent: Oct. 17, 2017

(54) METHOD FOR CONTROLLING AN EXPANSION DEVICE OF A VAPOR COMPRESSION SYSTEM DURING START-UP USING RATES OF CHANGE OF AN EVAPORATOR INLET AND OUTLET TEMPERATURE

(71) Applicant: Danfoss A/S, Nordborg (DK)

(72) Inventors: Roozbeh Izadi-Zamanabadi, Soenderborg (DK); Hans Joergen Jensen, Nordborg (DK); Lars Jensen, Nordborg (DK)

(73) Assignee: Danfoss A/S, Nordborg (DK)

( * ) Notice: Subject to any disclaimer, the term of this patent is extended or adjusted under 35 U.S.C. 154(b) by 120 days.

(21) Appl. No.: 14/422,380

(22) PCT Filed: Jul. 11, 2013

(86) PCT No.: PCT/DK2013/050236
§ 371 (c)(1),
(2) Date: Feb. 19, 2015

(87) PCT Pub. No.: WO2014/029402
PCT Pub. Date: Feb. 27, 2014

(65) Prior Publication Data

US 2015/0233623 A1 Aug. 20, 2015

(30) Foreign Application Priority Data

Aug. 23, 2012 (DK) ..... 2012 00517

(51) Int. Cl.
*F25B 1/00* (2006.01)

(52) U.S. Cl.
CPC ..... *F25B 1/00* (2013.01); *F25B 2345/003* (2013.01); *F25B 2500/26* (2013.01);
(Continued)

(58) Field of Classification Search
CPC ..... F25B 2600/21; F25B 2700/21174; F25B 2345/003; F25B 2600/05; F25B 2600/2513; F25B 2700/21175; F25B 2500/26
See application file for complete search history.

(56) References Cited

U.S. PATENT DOCUMENTS 4,481,788 A * 11/1984 Yoshino ..... F24D 17/02 236/91 C
5,247,806 A * 9/1993 Ebisu ..... F24F 3/065 236/78 D
(Continued)

FOREIGN PATENT DOCUMENTS

CN 1808023 A 7/2006
CN 101276226 A 10/2008
(Continued)

OTHER PUBLICATIONS

Danish Search Report Serial No. PA201200517 dated Mar. 11, 2013.
International Search Report for PCT Serial No. PCT/DK2013/050236 dated Oct. 16, 2013.

*Primary Examiner* — David Teitelbaum
(74) *Attorney, Agent, or Firm* — McCormick, Paulding & Huber LLP

(57) ABSTRACT

A method for controlling a vapor compression system during start-up is disclosed. The rate of change, $\Delta T_1$, of the temperature of refrigerant entering the evaporator, and the rate of change, $\Delta T_2$, of the temperature of refrigerant leaving the evaporator are compared. Based on the comparing step, a refrigerant filling state of the evaporator is determined. The opening degree of the expansion device is then controlled according to a first control strategy in the case that it is determined that the evaporator is full or almost full, and according to a second control strategy in the case that it is
(Continued)

determined that the evaporator is not full. Thereby it is ensured that a maximum filling degree of the evaporator is quickly reached, without risking that liquid refrigerant passes through the evaporator.

20 Claims, 4 Drawing Sheets

(52) U.S. Cl.
CPC ..... *F25B 2600/05* (2013.01); *F25B 2600/21* (2013.01); *F25B 2600/2513* (2013.01); *F25B 2700/21174* (2013.01); *F25B 2700/21175* (2013.01)

(56) References Cited

U.S. PATENT DOCUMENTS

| | | | | |
|---|---|---|---|---|
| 5,771,703 | A | 6/1998 | Rajendran | |
| 6,035,651 | A | 3/2000 | Carey | |
| 6,266,968 | B1 | 7/2001 | Redlich | |
| 2009/0071175 | A1* | 3/2009 | Pham | F25B 49/005 62/129 |
| 2009/0228153 | A1* | 9/2009 | Ogawa | F25B 41/062 700/282 |

FOREIGN PATENT DOCUMENTS

| | | | |
|---|---|---|---|
| CN | 101978227 | A | 2/2011 |
| EP | 0146486 | A2 | 6/1985 |
| EP | 1707903 | A2 | 10/2006 |

* cited by examiner

METHOD FOR CONTROLLING AN EXPANSION DEVICE OF A VAPOR COMPRESSION SYSTEM DURING START-UP USING RATES OF CHANGE OF AN EVAPORATOR INLET AND OUTLET TEMPERATURE

CROSS-REFERENCE TO RELATED APPLICATION

This application is entitled to the benefit of and incorporates by reference subject matter disclosed in International Patent Application No. PCT/DK2013/050236 filed on Jul. 11, 2013 and Danish Patent Application PA 2012 00517 filed Aug. 23, 2012.

FIELD OF THE INVENTION

The present invention relates to a method for controlling a vapour compression system, such as a refrigeration system, an air condition system or a heat pump, during start-up of the vapour compression system. The method of the invention allows the evaporator of the vapour compression system to be filled quickly without risking that liquid refrigerant passes through the evaporator and enters the suction line.

BACKGROUND

A vapour compression system normally comprises a compressor, a condenser, an expansion device, e.g. in the form of an expansion valve, and an evaporator arranged in a refrigerant path. Refrigerant is circulated in the refrigerant path, and is alternatingly compressed and expanded, while heat exchange takes place in the condenser and the evaporator, thereby providing heating or cooling for a closed volume.

When a vapour compression system is started, e.g. by starting the compressor, the amount of refrigerant present in the evaporator, or the filling degree of the evaporator, is not known. In order to obtain a maximum cooling efficiency, it is desirable to reach maximum filling degree of the evaporator as quickly as possible. On the other hand, it should be ensured that liquid refrigerant is prevented from passing through the evaporator and entering the suction line, since it may damage the compressor if liquid refrigerant reaches it.

U.S. Pat. No. 5,771,703 discloses a control system for controlling the flow of refrigerant in a vapour compression system. The control system causes optimal use of the evaporator coil by ensuring that the refrigerant in the coil is in the liquid state. A temperature sensor at the evaporator coil exit senses refrigerant temperature and the control system regulates refrigerant flow so that the liquid dry out point, i.e. the transition between liquid state and superheat state, occurs in the vicinity of this sensor. Thereby the vapour compression system is operated at optimal superheat during normal operation.

SUMMARY

It is an object of embodiments of the invention to provide a method for controlling a vapour compression system during start-up, which allows an optimal filling degree of the evaporator to be reached quickly, without risking flooding of the evaporator, regardless of the initial filling degree of the evaporator.

The present invention provides a method for controlling a vapour compression system during start-up, the vapour compression system comprising a compressor, a condenser, an expansion device having a variable opening degree, and an evaporator arranged along a refrigerant path, the method comprising the steps of:

starting operation of the vapour compression system, monitoring a first temperature, $T_1$, of refrigerant entering the evaporator, monitoring a second temperature, $T_2$, of refrigerant leaving the evaporator, deriving a first rate of change, $\Delta T_1$, of the first temperature, and a second rate of change, $\Delta T_2$, of the second temperature, comparing the first rate of change, $\Delta T_1$, to the second rate of change, $\Delta T_2$, based on the comparing step, determining a refrigerant filling state of the evaporator, and controlling the opening degree of the expansion device according to a first control strategy in the case that it is determined that the evaporator is full or almost full, and controlling the opening degree of the expansion device according to a second control strategy in the case that it is determined that the evaporator is not full.

The present invention provides a method for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc. The vapour compression system, thus, comprises a compressor, a condenser, an expansion device, e.g. in the form of an expansion valve, and an evaporator, arranged along a refrigerant path.

The compressor may be in the form of a single compressor, e.g. a fixed speed compressor, a two stage compressor or a variable speed compressor. Alternatively, the compressor may be in the form of a compressor rack comprising two or more individual compressors. Each of the compressors in the compressor rack could be a fixed speed compressor, a two stage compressor or a variable speed compressor.

The expansion device is of a kind which has a variable opening degree. Thus, by adjusting the opening degree of the expansion device, the flow of refrigerant which is supplied to the evaporator can be controlled.

The evaporator may be in the form of a single evaporator comprising a single evaporator coil or two or more evaporator coils arranged in parallel. As an alternative, the evaporator may comprise two or more evaporators arranged in parallel in the refrigerant path.

According to the method of the present invention, the vapour compression system is controlled during start-up of the vapour compression system. In the present context the term 'start-up' should be interpreted to mean a situation where operation of the vapour compression system is initiated for the first time, or a situation where operation of the vapour compression system is initiated after the operation of the vapour compression system has been stopped for a period of time. In such situations the amount of refrigerant present in the evaporator, or the filling degree of the evaporator, is not known. It is therefore not known whether the evaporator is close to a maximum filling degree, i.e. is almost full, or the evaporator is almost empty. This will be described further below.

According to the method of the invention, operation of the vapour compression system is initially started. Then a first temperature, $T_1$, of refrigerant entering the evaporator, and a second temperature, $T_2$, of refrigerant leaving the evaporator are monitored. In the present context the term 'monitor' should be interpreted to mean that the relevant temperature is measured for a certain period of time, as opposed to a point measurement of the temperature. Thus, by monitoring the temperatures, data sets are obtained which represent the development of the first temperature and of the second temperature as a function of time. The obtained data sets may, e.g., be in the form of a number of discrete or sampled temperature measurements, or in the form of substantially continuous temperature measurements.

Based on the monitored temperatures, a first rate of change, $\Delta T_1$, of the first temperature, and a second rate of change, $\Delta T_2$, of the second temperature are derived. The first rate of change, $\Delta T_1$, is then compared to the second rate of change, $\Delta T_2$. Based on the comparing step, a refrigerant filling state of the evaporator is determined.

In the present context the term 'refrigerant filling state' should be interpreted to mean a state of the evaporator which relates to the filling degree of the evaporator. The refrigerant filling state may simply be whether the evaporator is full or almost full, or the evaporator is not full, e.g. almost empty. Alternatively, the refrigerant filling state may be a more accurate measure for the filling degree, e.g. corresponding to 'full or almost full', 'approximately half full' and 'empty or almost empty'. As another alternative, the refrigerant filling state may simply be the filling degree.

In any event, once the refrigerant filling state has been determined it is at least possible to determine whether the evaporator is full or almost full, or the evaporator is not full.

As described above, it is desirable to obtain a maximum filling degree of the evaporator as quickly as possible, because thereby a maximum cooling capacity is obtained. However, it must also be ensured that liquid refrigerant is not allowed to pass through the evaporator and enter the suction line, because it may cause damage to the compressor if liquid refrigerant reaches the compressor. It is therefore an advantage of the present invention that the refrigerant filling state of the evaporator is determined as described above, because it allows relatively aggressive filling of the evaporator if it turns out that the evaporator is not full, while a more careful approach can be selected if it turns out that the evaporator is full or almost full. Thereby it can be ensured that the evaporator is filled as quickly as possible, while preventing that liquid refrigerant passes through the evaporator.

Thus, according to the present invention, the opening degree of the expansion device is controlled according to a first control strategy in the case that it is determined that the evaporator is full or almost full, and the opening degree of the expansion device is controlled according to a second control strategy in the case that it is determined that the evaporator is not full.

The first control strategy may comprise the step of gradually decreasing the opening degree of the expansion device. Since the first control strategy is selected in the case where the evaporator is full or almost full, a careful approach must be taken in order to ensure that liquid refrigerant is not allowed to pass through the evaporator. Assuming that an intermediate opening degree of the expansion device, providing an intermediate supply of refrigerant to the evaporator, has initially been selected, it will be appropriate to decrease the opening degree of the expansion device in this case, thereby reducing the supply of refrigerant to the evaporator. Furthermore, since it has already been established that the evaporator is full or almost full, the maximum filling degree has already been reached, or almost reached, and the vapour compression system is already operating at maximum cooling capacity. A high refrigerant supply to the evaporator is therefore not required in this case.

In this case the method may further comprise the steps of:

monitoring a difference between the first temperature, $T_1$, and the second temperature, $T_2$, during the step of gradually decreasing the opening degree of the expansion device, and discontinuing decreasing the opening degree of the expansion device in the case that the difference between the first temperature, $T_1$, and the second temperature, $T_2$, exceeds a predetermined threshold value.

As described above, when the opening degree of the expansion device is decreased, the supply of refrigerant to the evaporator is also decreased. Thereby the filling degree of the evaporator will also decrease. As the filling degree decreases, an increasing part of the evaporator contains gaseous refrigerant, and the temperature of the refrigerant leaving the evaporator will increase. Therefore the difference between the temperature of refrigerant entering the evaporator, i.e. $T_1$, and the temperature of refrigerant leaving the evaporator, i.e. $T_2$, will increase. When the temperature difference reaches the predetermined threshold value, it is an indication that the filling degree is so low that the vapour compression system is no longer operated in an efficient manner. Therefore it is no longer desirable to decrease the opening degree of the expansion device, and the decrease in opening degree is therefore discontinued.

Alternatively or additionally, the second control strategy may comprise the step of gradually increasing the opening degree of the expansion device. Since the second control strategy is selected in the case where the evaporator is not full, it is safe to take an aggressive approach in order to ensure that a maximum filling degree is quickly reached. Assuming that an intermediate opening degree of the expansion device, providing an intermediate supply of refrigerant to the evaporator, has initially been selected, it will be safe to increase the opening degree of the expansion device in this case, thereby increasing the supply of refrigerant to the evaporator, and thereby a maximum filling degree can be reached faster. Since it has already been established that the evaporator is not full, this can be done safely without risking that liquid refrigerant passes the evaporator and enters the suction line.

In this case the method may further comprise the steps of:

monitoring the second rate of change, $\Delta T_2$, during the step of gradually increasing the opening degree of the expansion device, and discontinuing increasing the opening degree of the expansion device in the case that the numerical value of the second rate of change, $\Delta T_2$, exceeds a predetermined threshold value.

As described above, when the opening degree of the expansion device is increased, the supply of refrigerant to the evaporator is also increased, and thereby the filling degree of the evaporator is increased. When the maximum filling degree is reached, the temperature of the refrigerant leaving the evaporator, i.e. $T_2$, decreases drastically towards the evaporating temperature, because the gaseous zone inside the evaporator is eliminated or almost eliminated. Therefore, when such a drastic decrease in $T_2$ is detected, it is an indication that the evaporator is full or almost full, and therefore it is no longer safe to increase the opening degree of the expansion device. Therefore the increase in the opening degree is discontinued.

The method may further comprise the step of:

monitoring the second temperature, $T_2$, during the step of gradually increasing the opening degree of the expansion device, and the step of discontinuing increasing the opening degree may only be performed if the second temperature has decreased by a predetermined amount as compared to an initial temperature value of the second temperature.

In some cases a drastic decrease in the temperature of refrigerant leaving the evaporator may occur shortly after starting operation of the vapour compression system, even though the maximum filling degree has not been reached. Thus, in order to avoid that the increase in the opening degree of the expansion device is erroneously discontinued in this case, the second temperature is monitored in order to ensure that the temperature of refrigerant leaving the evaporator has been decreased to a level which indicates that the maximum filling state has been reached before the increase in the opening degree is discontinued.

The method may further comprise the step of decreasing the opening degree of the expansion device to an initial opening degree after the step of discontinuing increasing the opening degree of the expansion device. According to this embodiment the increase in the opening degree of the expansion device is not only discontinued, but the opening degree is also decreased to an initial opening degree, e.g. to an intermediate opening degree which was selected before the increase in opening degree of the expansion device is commenced.

As an alternative, the increase in the opening degree of the expansion device may simply be discontinued, and the opening degree may be maintained at the level which was reached when the increase was discontinued.

The step of monitoring a first temperature, $T_1$, may be performed by means of a first temperature sensor arranged in the refrigerant path at an inlet opening of the evaporator, and/or the step of monitoring a second temperature, $T_2$, may be performed by means of a second temperature sensor arranged in the refrigerant path at an outlet opening of the evaporator. According to this embodiment, the temperatures are measured directly by means of temperature sensors arranged directly in contact with the refrigerant flow.

As an alternative, a more indirect measurement of one or both of the temperatures, e.g. by means of temperature sensors arranged on an outer part of tubing forming the refrigerant path, may be applied.

In the case that the temperatures are measured by means of temperature sensors arranged in the refrigerant path as described above, the method may further comprise the step of calibrating the first temperature sensor.

The step of calibrating the first temperature sensor may be performed during start-up of the vapour compression system. Alternatively or additionally, the step of calibrating the first temperature sensor may be performed during normal operation of the vapour compression system.

The calibration of the first temperature sensor may, e.g., be performed by performing the steps of:

alternatingly increasing and decreasing the opening degree of the expansion device between a maximum opening degree and a minimum opening degree, thereby defining a plurality of cycles of the opening degree of the expansion device, at least for a part of each cycle of the opening degree of the expansion device, monitoring a temperature of refrigerant entering the evaporator by means of the first temperature sensor, $S_1$, and monitoring a temperature of refrigerant leaving the evaporator by means of the second temperature sensor, $S_2$, for each cycle of the opening degree of the expansion device, registering a maximum temperature, $T_{1,max}$, measured by the first temperature sensor, $S_1$, and registering a minimum temperature, $T_{2,min}$, measured by the second temperature sensor, $S_2$, for each cycle of the opening degree of the expansion device, calculating a calibration value, $\Delta T_1$, as $\Delta T_1 = C - (T_{2,min} - T_{1,max})$, where C is a constant, selecting a maximum calibration value, $\Delta T_{1,max}$, among the calibration values, $\Delta T_1$, calculated for each of the plurality of cycles of the opening degree of the expansion device, and adjusting temperature measurements performed by the first temperature sensor, $S_1$, by an amount defined by $\Delta T_{1,max}$.

As an alternative, $\Delta T_1$ could be calculated in the following manner. For each cycle, the temperature difference, $T_2 - T_1$, is monitored, i.e. temperature differences occurring at any given time, or at selected points in time, during the cycle are obtained. Then the minimal temperature difference, $\min(T_2 - T_1)$ is selected. Finally, $\Delta T_1$ is calculated as $\Delta T_1 = C - \min(T_2 - T_1)$. This approach may be appropriate in the case that the evaporator is relatively short, while the approach described above may be appropriate for longer evaporators.

The step of starting operation of the vapour compression system may comprise starting operation of the compressor.

BRIEF DESCRIPTION OF THE DRAWINGS

The invention will now be described in further details with reference to the accompanying drawings in which.

DETAILED DESCRIPTION

Figure 1:
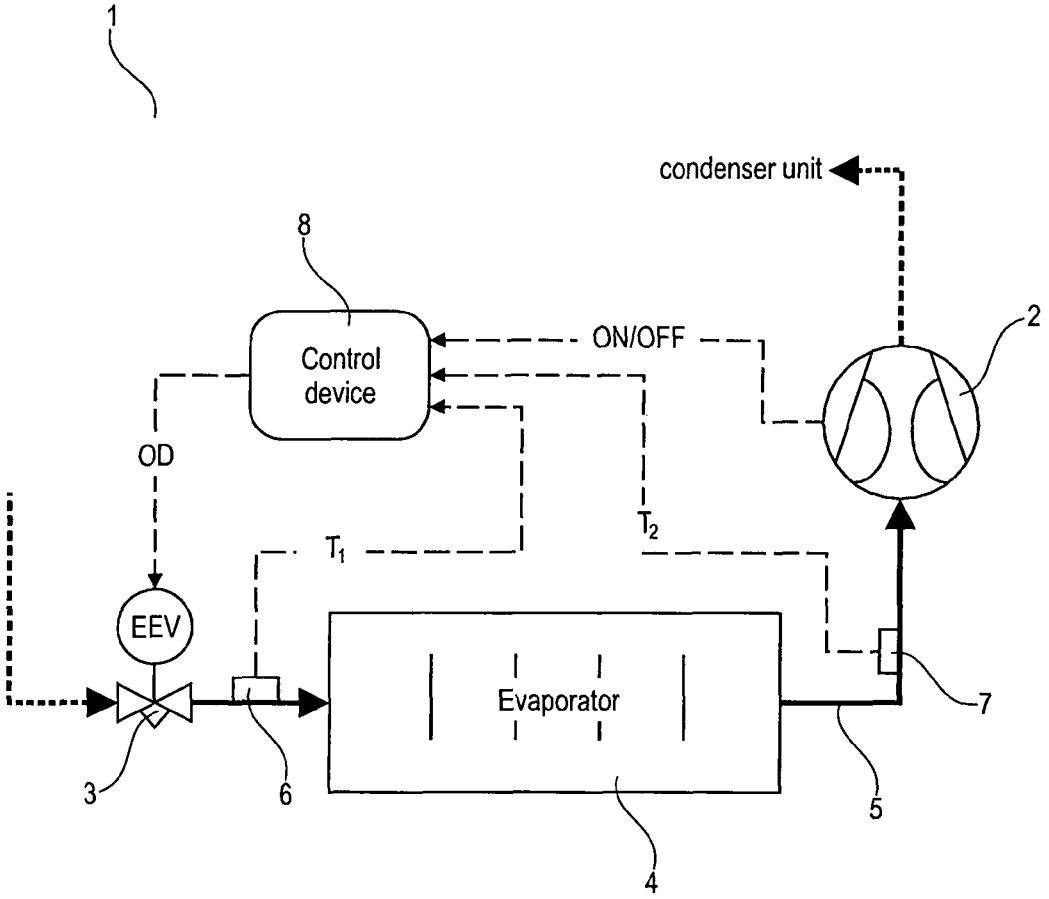
FIG. 1 is a diagrammatic view of a part of a vapour compression system used for performing the method according to an embodiment of the invention.

FIG. 1 is a diagrammatic view of a part of a vapour compression system 1. The vapour compression system 1 comprises a compressor 2, a condenser (not shown), an expansion device 3, in the form of an electronic expansion valve (EEV), and an evaporator 4, arranged along a refrigerant path 5. A first temperature sensor 6 is arranged in the refrigerant path 5 at an inlet opening of the evaporator 4, and a second temperature sensor 7 is arranged in the refrigerant path 5 at an outlet opening of the evaporator 4. Thus, the first temperature sensor 6 measures the temperature, $T_1$, of refrigerant entering the evaporator 4, and the second temperature sensor 7 measures the temperature, $T_2$, of refrigerant leaving the evaporator 4.

The temperature signals, $T_1$ and $T_2$, are communicated to a control device 8 with the purpose of controlling the opening degree of the expansion device 3 in such a manner that an optimal superheat value is obtained. Accordingly, the control device 8 is adapted to generate and supply a control signal to the expansion device 3.

Furthermore, the control device 8 receives an ON/OFF signal from the compressor 2 indicating whether the compressor is operating or not. This information is also taken into account when the control signal to the expansion device 3 is generated.

During start-up of the vapour compression system 1, e.g. when the compressor 2 is started, the vapour compression system 1 may be operated according to an embodiment of the invention. Thus, on the basis of the temperature measurements performed by the temperature sensors 6, 7, it can be established if the evaporator 4 is full or almost full, or if the evaporator 4 is not full, and the opening degree of the expansion device 3 can then be controlled in accordance with the filling degree of the evaporator 4, as described above. This will be described in further detail below.

Figure 2:
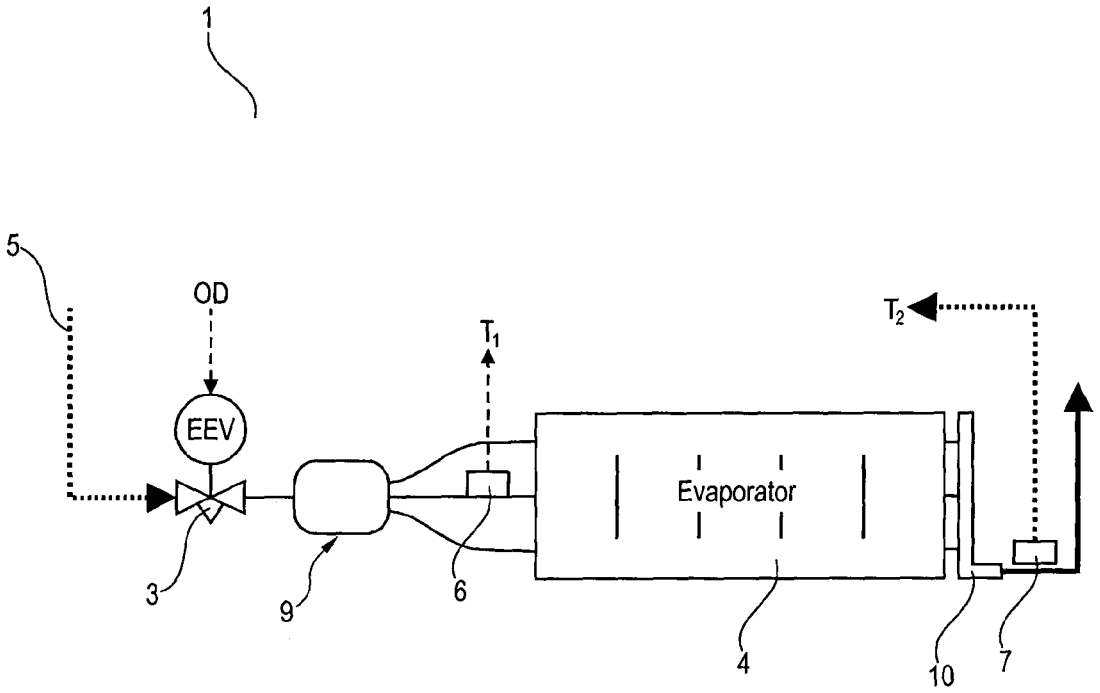
FIG. 2 is a diagrammatic view of a part of a vapour compression system used for performing the method according to an alternative embodiment of the invention.

FIG. 2 is a schematic view of a part of a vapour compression system 1, which is similar to the vapour compression system 1 of FIG. 1. In the vapour compression system 1 of FIG. 2, the evaporator 4 is of a kind comprising three evaporator coils. Accordingly, a distributor 9 is arranged in the refrigerant path 5 between the expansion device 3 and the evaporator 4. The distributor 9 splits the refrigerant flow from the expansion device 3 into three paths, each entering an evaporator coil of the evaporator 4. Similarly, a collector 10 collects the refrigerant leaving the evaporator 4 via the three evaporator coils into a single refrigerant flow.

The first temperature sensor 6 is arranged in one of the three flow paths, between the distributor 9 and the evaporator 4. Thus, the first temperature sensor 6 measures the temperature of the refrigerant entering one of the evaporator coils. The second temperature sensor 7 is arranged in the collected refrigerant flow leaving the collector 10. Thus, the second temperature sensor 7 measures the temperature of the collected refrigerant from all three evaporator coils, and thereby the temperature of the refrigerant which is actually entering the suction line rather than the temperature of refrigerant leaving one of the evaporator coils.

The temperatures measured by means of the temperature sensors 6, 7 shown in FIG. 2 can also be used as a basis for determining if the evaporator is full or almost full, or if the evaporator is not full.

Figure 3:
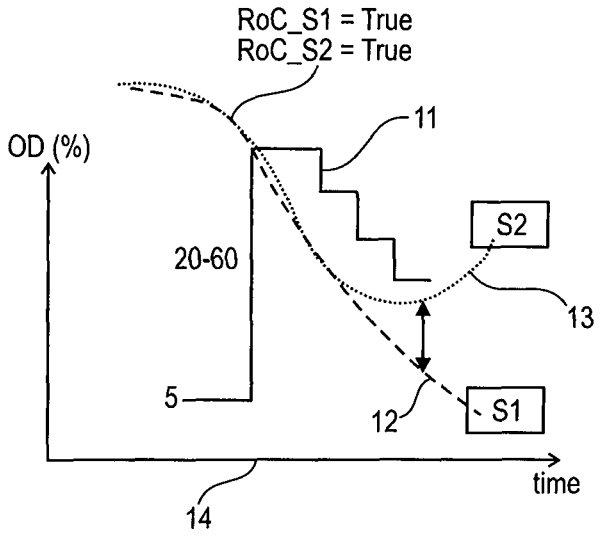
FIG. 3 is a graph illustrating opening degree, inlet temperature and outlet temperature during start-up of a vapour compression system according to a first control strategy.

FIG. 3 is a graph illustrating opening degree 11 of an expansion device of a vapour compression system, the temperature 12 of refrigerant entering an evaporator of the vapour compression system, and the temperature 13 of refrigerant leaving the evaporator, as a function of time. The vapour compression system may be of the kind shown in FIG. 1 or of the kind shown in FIG. 2. In this case the temperature 12 of refrigerant entering the evaporator is measured by means of the first temperature sensor 6, and the temperature 13 of refrigerant leaving the evaporator is measured by means of the second temperature sensor 7.

The graph of FIG. 3 illustrates a method of controlling the opening degree of the expansion device during start-up of the vapour compression system in the case that the evaporator is full or almost full when operation of the vapour compression system is started.

At time 14 the operation of the vapour compression system is started, and the opening degree 11 of the expansion valve is increased to an intermediate level. The temperature 12 of refrigerant entering the evaporator and the temperature 13 of refrigerant leaving the evaporator are then monitored. More particularly, the rate of change of each of the monitored temperatures 12, 13 is derived, and the rates of change are compared to each other.

In the situation illustrated in FIG. 3, the rate of change of the temperature 12 of refrigerant entering the evaporator is substantially identical to the rate of change of the temperature 13 of refrigerant leaving the evaporator. In other words, the temperature 12 of refrigerant entering the evaporator and the temperature 13 of refrigerant leaving the evaporator decrease in substantially the same manner immediately after operation of the vapour compression system has been started. This is an indication that the evaporator is full or almost full, since in this case the superheat of the refrigerant leaving the evaporator is very small. Thus, based on the monitoring of the refrigerant temperatures 12, 13 and on the derived rates of change of the temperatures 12, 13, it can be established that the evaporator is full or almost full.

Since the evaporator is full or almost full, there is a risk that liquid refrigerant leaves the evaporator and enters the suction line. As described above, this is undesirable, since liquid refrigerant may cause damage if it is allowed to reach the compressor. Therefore, in order to avoid that liquid refrigerant leaves the evaporator, the refrigerant supply to the evaporator is decreased by gradually decreasing the opening degree 11 of the expansion device.

While the opening degree 11 of the expansion device is gradually decreased, the difference between the temperature 12 of refrigerant entering the evaporator and the temperature of refrigerant leaving the evaporator is monitored. It can be seen in FIG. 3 that, at a certain point in time, the temperature 13 of refrigerant leaving the evaporator starts to increase, while the temperature 12 of refrigerant entering the evaporator continues to decrease. Thereby the temperature difference between the measured temperatures 12, 13 increases. This is an indication that the filling degree of the evaporator has decreased to a level where the superheat of the refrigerant leaving the evaporator is no longer minimal, and the vapour compression system is therefore not operated in an optimal manner. Therefore it is no longer desirable to decrease the supply of refrigerant to the evaporator, and the decreasing of the opening degree 11 of the expansion device is therefore discontinued when this behaviour is detected. In addition, the opening degree 11 of the expansion device may subsequently be gradually increased, until it is detected that the evaporator is once again full or almost full. However, this is not illustrated in FIG. 3.

Figure 4:
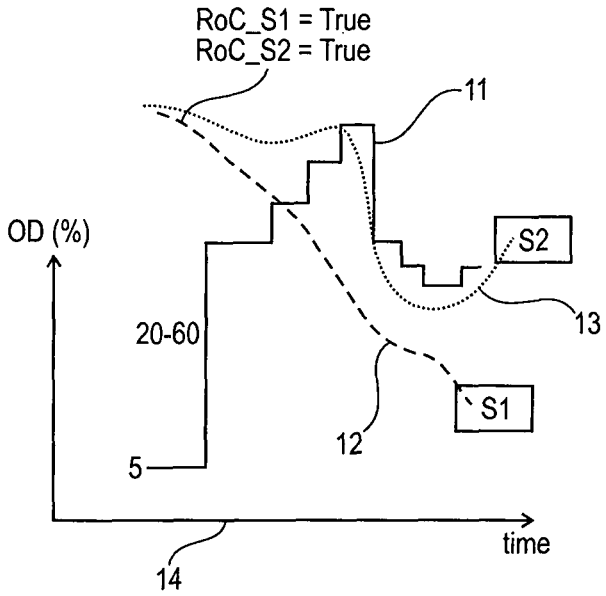
FIG. 4 is a graph illustrating opening degree, inlet temperature and outlet temperature during start-up of a vapour compression system according to a second control strategy.

FIG. 4 is also a graph illustrating opening degree 11 of an expansion device of a vapour compression system, the temperature 12 of refrigerant entering an evaporator of the vapour compression system, and the temperature 13 of refrigerant leaving the evaporator, as a function of time. The vapour compression system may be of the kind shown in FIG. 1 or of the kind shown in FIG. 2. In this case the temperature 12 of refrigerant entering the evaporator is measured by means of the first temperature sensor 6, and the temperature 13 of refrigerant leaving the evaporator is measured by means of the second temperature sensor 7.

The graph of FIG. 4 illustrates a method of controlling the opening degree of the expansion device during start-up of the vapour compression system in the case that the evaporator is not full when operation of the vapour compression system is started.

At time 14 the operation of the vapour compression system is started, and the opening degree 11 of the expansion valve is increased to an intermediate level. The temperature 12 of refrigerant entering the evaporator and the temperature 13 of refrigerant leaving the evaporator are then monitored. More particularly, the rate of change of each of the monitored temperatures 12, 13 is derived, and the rates of change are compared to each other. This is exactly the same process which is described above with reference to FIG. 3. Thus, each time the vapour compression system is started, the intermediate level of the opening degree 11 of the expansion device is selected, and the rates of change of the refrigerant temperatures 12, 13 are monitored and compared in order to determine if the evaporator is full or almost full, or if the evaporator is not full.

In the situation illustrated in FIG. 4, the temperature 12 of refrigerant entering the evaporator decreases faster than the temperature 13 of refrigerant leaving the evaporator. This indicates that gaseous and heated refrigerant is leaving the evaporator, and thereby that the evaporator is not full. It is desirable to reach a maximum filling degree of the evaporator as quickly as possible, because the most efficient operation of the vapour compression system is obtained at maximum filling degree. Therefore, when this situation is detected, the supply of refrigerant to the evaporator is increased by gradually increasing the opening degree 11 of the expansion device. Furthermore, this can safely be done, since it has already been established that the evaporator is not full, and there is therefore no risk that an increased refrigerant supply to the evaporator will result in liquid refrigerant passing through the evaporator.

While the opening degree 11 of the expansion device is gradually increased, the rate of change of the temperature 13 of refrigerant leaving the evaporator is monitored. It can be seen in FIG. 4 that at a certain point in time, the temperature 13 of refrigerant leaving the evaporator decreases drastically. This is an indication that the evaporator is full or almost full, since in this case the temperature 13 of refrigerant leaving the evaporator will quickly approach the liquid temperature, since the gaseous refrigerant leaving the evaporator is no longer heated in the evaporator. When the evaporator is full or almost full, there is a risk that liquid refrigerant may pass through the evaporator, and it is therefore no longer desirable to increase the supply of refrigerant to the evaporator, and the gradual increase in opening degree 11 of the expansion device is therefore discontinued. Furthermore, the opening degree 11 of the expansion device is decreased to the initial, intermediate level at this point. Subsequently the opening degree 11 of the expansion device is controlled in a usual manner in order to obtain an optimal superheat value.

FIGS. 3 and 4 illustrate that each time the vapour compression system is started, the same initial steps are performed, and an intermediate opening degree 11 of the expansion device is selected. Then it is determined, based on the monitored rates of change of the temperatures 12, 13, if the evaporator is full or almost full, or if the evaporator is not full. If it is determined that the evaporator is full or almost full, the careful approach illustrated in FIG. 3 is selected in order to avoid that liquid refrigerant passes through the evaporator. If it is determined that the evaporator is not full, the more aggressive approach illustrated in FIG. 4 is selected in order to ensure that the maximum filling degree is reached as quickly as possible.

Thus, regardless of whether or not the evaporator is initially full, it is ensured that a maximum filling degree is quickly reached, while it is ensured that liquid refrigerant is not allowed to pass through the evaporator.

Figure 5:
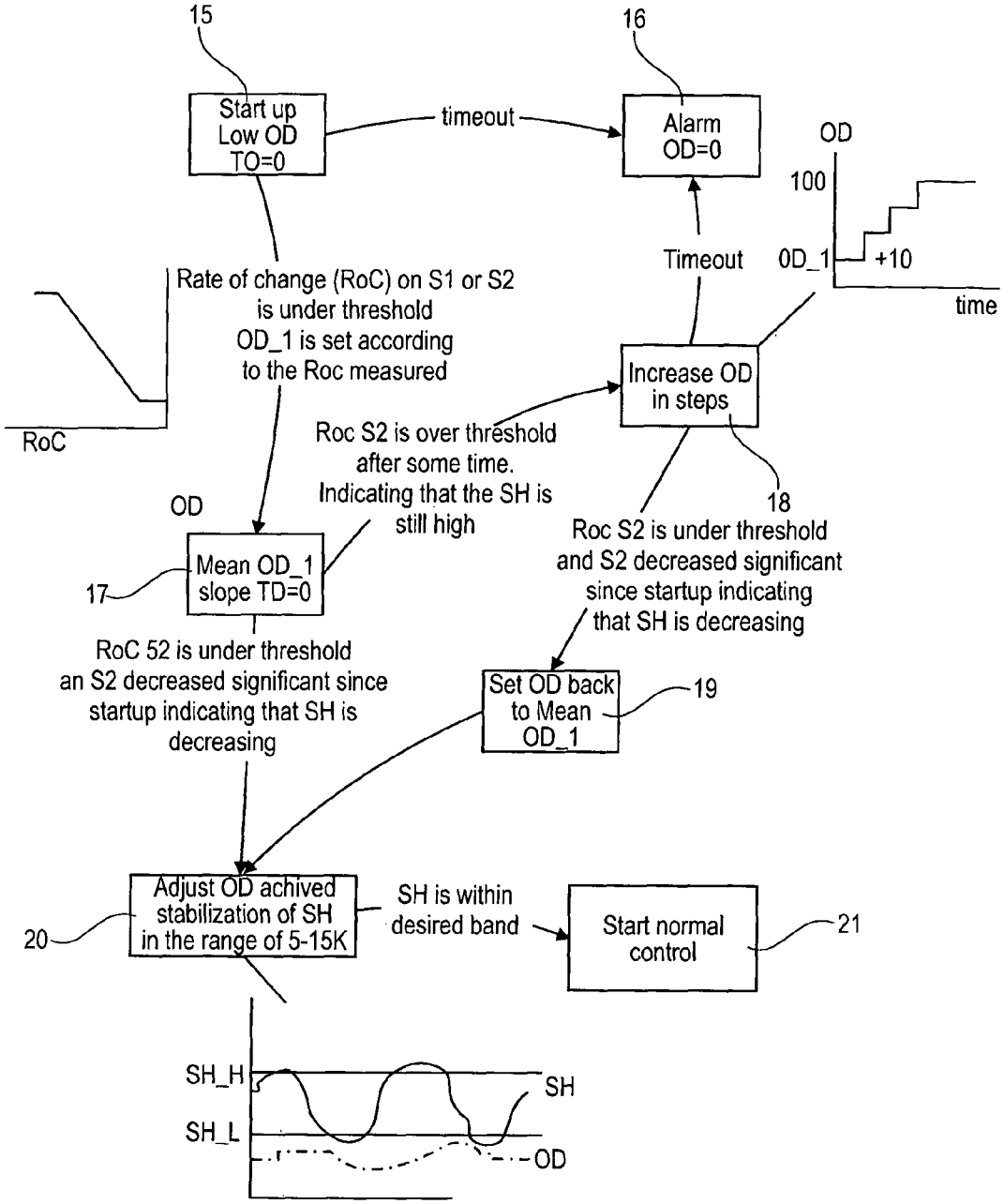
FIG. 5 is a flow diagram illustrating a method according to an embodiment of the invention.

FIG. 5 is a flow chart illustrating a method according to an embodiment of the invention. The process is started at step 15, where the vapour compression system is started, and a low opening degree of the expansion device is selected. The rate of change of the temperature of refrigerant entering the evaporator and the rate of change of the temperature of refrigerant leaving the evaporator are then monitored. If nothing happens, the process times out, and an alarm is initiated at step 16, informing an operator that the opening degree of the expansion device is low.

If it is determined that the rate of change of the temperature of refrigerant entering the evaporator, or the rate of change of the temperature of refrigerant leaving the evaporator is under a given threshold value, the opening degree of the expansion device is increased to an intermediate level, at step 17.

If it is then determined that the rate of change of the temperature of refrigerant leaving the evaporator is over the threshold after some time, it is an indication that the superheat value is still high. Therefore the opening degree of the expansion device is, in this case, increased gradually, at step 18. If nothing happens, the process times out, and an alarm is initiated at step 16.

If, after step 18, it is determined that the rate of change of the temperature of refrigerant leaving the evaporator is under the threshold value, and that the temperature or refrigerant leaving the evaporator has decreased significantly since start-up, it is an indication that the superheat value is decreasing. Therefore the gradual increase in opening degree of the expansion device is discontinued, and the opening degree is decreased to the initial, intermediate value, at step 19.

Then, at step 20, the opening degree of the expansion device is adjusted in order to obtain stabilisation of the superheat in the range of 5-15 K.

If, at step 17, it is determined that the rate of change of the temperature of refrigerant leaving the evaporator is under the threshold value, and that the temperature of refrigerant leaving the evaporator has decreased significantly since start-up, it is an indication that the superheat value is decreasing. Then the process is proceeded to step 20, described above.

Once the superheat value is within the desired band, the start-up procedure is ended, and normal control of the opening degree of the expansion device is commenced, at step 21.

The embodiments of the invention described above are provided by way of example only. The skilled person will be aware of many modifications, changes and substitutions that could be made without departing from the scope of the present invention. The claims of the present invention are intended to cover all such modifications, changes and substitutions as fall within the spirit and scope of the invention.

What is claimed is:

1. A method for controlling a vapour compression system during start-up, the vapour compression system comprising a compressor, a condenser, an expansion device having a variable opening degree, and an evaporator arranged along a refrigerant path, the method comprising the steps of:

starting operation of the vapour compression system, monitoring a first temperature, $T_1$, of refrigerant entering the evaporator, monitoring a second temperature, $T_2$, of refrigerant leaving the evaporator, deriving a first rate of change, $\Delta T_1$, of the first temperature, and a second rate of change, $\Delta T_2$, of the second temperature, comparing the first rate of change, $\Delta T_1$, to the second rate of change, $\Delta T_2$, based on the comparing step, determining whether the evaporator is full or is not full, and controlling an opening degree of the expansion device according to a first control strategy if the evaporator is determined to be full or controlling the opening degree of the expansion device according to a second control strategy if the evaporator is determined to be not full.

2. The method according to claim 1, wherein the first control strategy comprises the step of gradually decreasing the opening degree of the expansion device.

3. The method according to claim 2, further comprising the steps of:

monitoring a difference between the first temperature, $T_1$, and the second temperature, $T_2$, during the step of gradually decreasing the opening degree of the expansion device, and discontinuing decreasing the opening degree of the expansion device in the case that the difference between the first temperature, $T_1$, and the second temperature, $T_2$, exceeds a predetermined threshold value.

4. The method according to claim 1, wherein the second control strategy comprises the step of gradually increasing the opening degree of the expansion device.

5. The method according to claim 4, further comprising the steps of:

monitoring the second rate of change, $\Delta T_2$, during the step of gradually increasing the opening degree of the expansion device, and discontinuing increasing the opening degree of the expansion device in the case that the numerical value of the second rate of change, $\Delta T_2$, exceeds a predetermined threshold value.

6. The method according to claim 5, further comprising the step of:

monitoring the second temperature, $T_2$, during the step of gradually increasing the opening degree of the expansion device, wherein the step of discontinuing increasing the opening degree is only performed if the second temperature has decreased by a predetermined amount as compared to an initial temperature value of the second temperature.

7. The method according to claim 5, further comprising the step of decreasing the opening degree of the expansion device to an initial opening degree after the step of discontinuing increasing the opening degree of the expansion device.

8. The method according to claim 1, wherein the step of monitoring the first temperature, $T_1$, is performed by means of a first temperature sensor arranged in the refrigerant path at an inlet opening of the evaporator, and/or the step of monitoring the second temperature, $T_2$, is performed by means of a second temperature sensor arranged in the refrigerant path at an outlet opening of the evaporator.

9. The method according to claim 8, further comprising the step of calibrating the first temperature sensor.

10. The method according to claim 9, wherein the step of calibrating the first temperature sensor is performed during start-up of the vapour compression system.

11. The method according to claim 1, wherein the step of starting operation of the vapour compression system comprises starting operation of the compressor.

12. The method according to claim 2, wherein the second control strategy comprises the step of gradually increasing the opening degree of the expansion device.

13. The method according to claim 3, wherein the second control strategy comprises the step of gradually increasing the opening degree of the expansion device.

14. The method according to claim 6, further comprising the step of decreasing the opening degree of the expansion device to an initial opening degree after the step of discontinuing increasing the opening degree of the expansion device.

15. The method according to claim 2, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

16. The method according to claim 3, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

17. The method according to claim 4, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

18. The method according to claim 5, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

19. The method according to claim 6, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

20. The method according to claim 7, wherein the step of monitoring a first temperature, $T_1$, is performed by means of a first temperature sensor arranged in the refrigerant path at an inlet opening of the evaporator, and/or the step of monitoring a second temperature, $T_2$, is performed by means of a second temperature sensor arranged in the refrigerant path at an outlet opening of the evaporator.

* * * * *